United States Patent [19]

Havstad

[11] 4,445,503

[45] May 1, 1984

[54] PERCUSSOR ASSEMBLY

[75] Inventor: Harold R. Havstad, Eagle Point, Oreg.

[73] Assignee: Hudson Oxygen Therapy Sales Company, Temecula, Calif.

[21] Appl. No.: 223,355

[22] Filed: Jan. 8, 1981

Related U.S. Application Data

[63] Continuation-in-part of Ser. No. 50,685, Jun. 21, 1979, abandoned.

[51] Int. Cl.[3] ..... A61H 1/00

[52] U.S. Cl. ..... 128/40; 128/55; 128/64

[58] Field of Search ..... 128/38, 40, 50, 53, 128/55, 64, 65, 67; 91/403, 410, 432; 137/624.14

[56] References Cited

U.S. PATENT DOCUMENTS

| | | | |
|---|---|---|---|
| 2,052,098 | 8/1936 | Lockett | 128/40 |
| 2,646,039 | 7/1953 | Agosti | 128/64 |
| 3,058,461 | 10/1961 | Courtin | 128/38 |
| 3,326,237 | 6/1967 | Frick | 137/624.14 |

FOREIGN PATENT DOCUMENTS

| | | | |
|---|---|---|---|
| 740733 | 10/1931 | France | 128/53 |
| 7527223 | 3/1977 | France | 128/64 |
| 788394 | 1/1958 | United Kingdom | 128/40 |

*Primary Examiner*—Richard J. Apley
*Assistant Examiner*—David J. Brown
*Attorney, Agent, or Firm*—Seiler & Quirk

[57] ABSTRACT

A percussor assembly comprises a rigid body member having a gas inlet passageway and gas outlet passageway, a movable gas sealing member, and a gas pressure chamber communicating with the gas inlet passageway, the gas sealing member being forced from a first position forming a gas-tight seal between the gas pressure chamber and the gas outlet passageway to a second position in which the chamber and passageway are in communication to allow a burst of gas to pass from the chamber into the outlet passageway. A percussion head, which may be remote from the body member receives the burst of gas, the bursts being created successively at the percussion head.

3 Claims, 4 Drawing Figures

PERCUSSOR ASSEMBLY

REFERENCE TO OTHER APPLICATIONS

This application is a continuation-in-part of application Ser. No. 050,685, filed June 21, 1979 now abandoned.

BACKGROUND OF THE INVENTION

In my prior aforesaid co-pending application, there is disclosed a percussor in which a gas sealing member forms a gas-tight seal between two gas chambers, one of which is in direct communication with the gas inlet passageway, whereby gas in the first chamber accumulates to overcome the gas-tight seal allowing the pressurized gas to flow into the second chamber. When this occurs, a reciprocating member, which is in communication with the second chamber, is urged downwardly, and the gas in the second chamber is then vented from the device. Movement of this reciprocating member is repeated in a rapid fashion to achieve the percussive effect desired in the apparatus.

The present invention is directed to a further embodiment of such a percussor, incorporating a gas-tight sealing means cooperating with a gas pressure or accumulation chamber, but in which a second chamber is not required. The apparatus is particularly advantageous in being used with a remote percussion head unit, which may be very lightweight, making it especially adapted for an infant or pediatric percussor use.

SUMMARY OF THE INVENTION

The percussor of the present invention incorporates a solid percussor assembly body having therein a gas pressure chamber communicating with a gas inlet passageway. A gas outlet passageway is blocked from the gas pressure chamber by a gas sealing means, normally biased in the sealing or closed position. Gas is introduced into the gas pressure chamber at a pressure sufficient to overcome the seal, whereby a burst of the gas flows to the gas outlet passageway. The successive, high frequency bursts of gas are advantageously used to power a percussion head in a manner as will be described hereinafter.

DETAILED DESCRIPTION OF THE INVENTION

Figure 1:
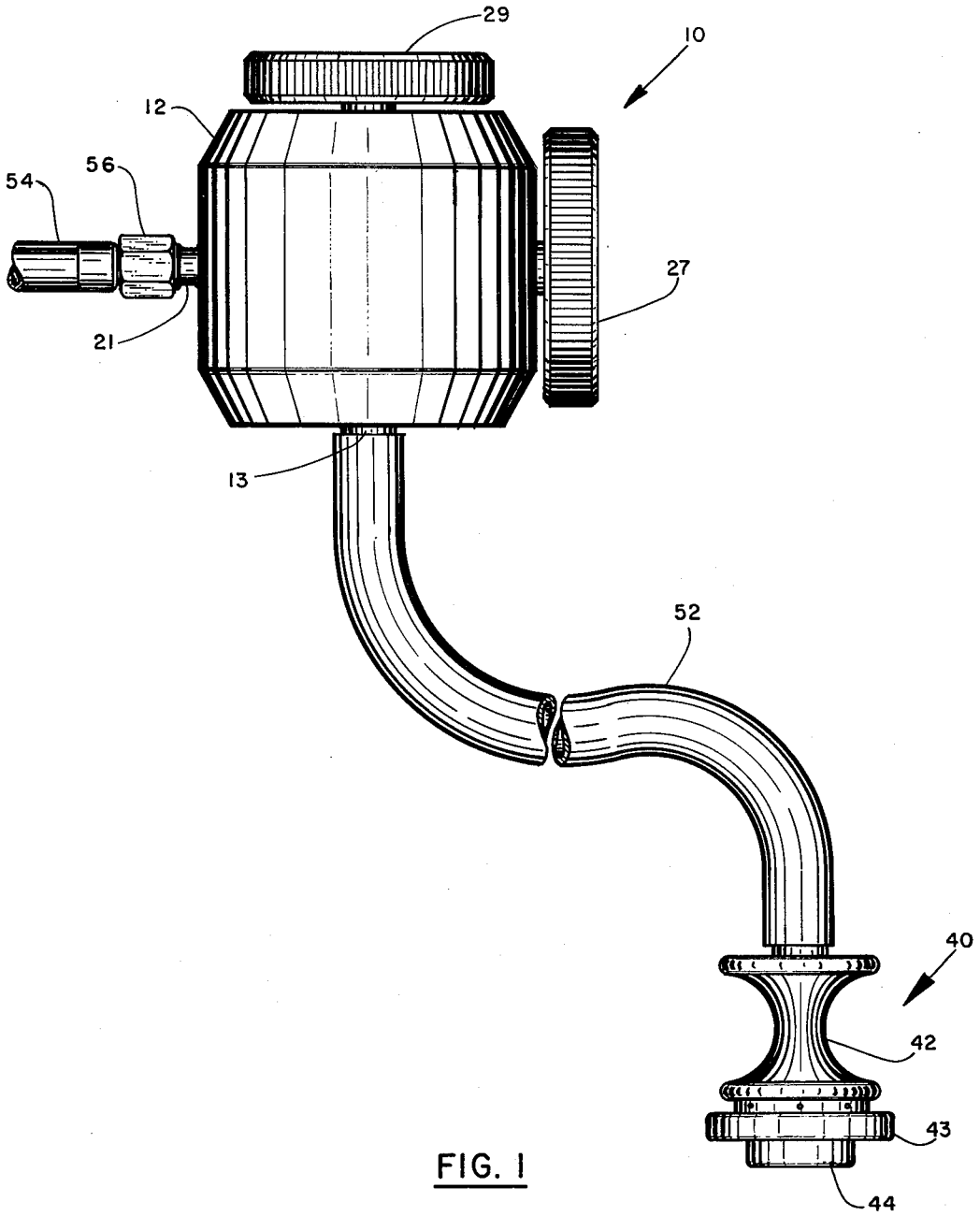
FIG. 1 is an exterior view of the percussor body and remote percussion head assemblies of the invention.
Figure 2:
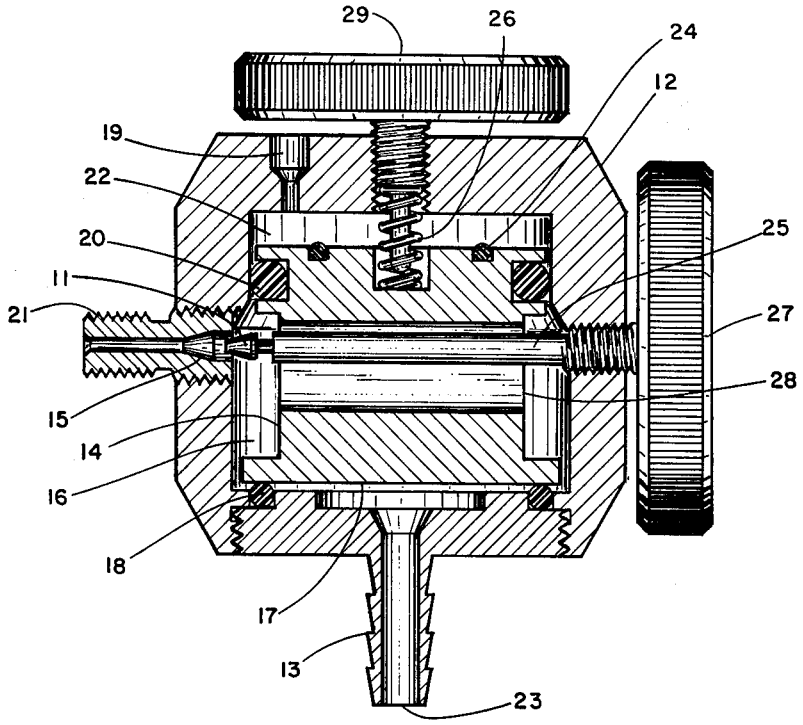
FIG. 2 is a side sectional elevation of the percussor body shown in FIG. 1.

The apparatus of the invention incorporates a percussor body assembly 10, illustrated generally in FIG. 1, which body assembly includes an inlet pipe 21 and an outlet pipe 13. These pipes may be formed as integral components of the rigid body 12, or may be pipe fittings secured to the body, such as by threaded engagements, whereby they may be removed. Fittings of the latter type are illustrated in FIG. 2. Also illustrated are a gas supply tube 54 and an adapter 56 whereby a supply of gas is directed into the percussor body through the inlet pipe 21. A suitable length of tubing 52 is secured to outlet pipe 13 and extends from the percussor body 12 to a remote percussion head assembly 40. Any suitable length of tubing may be used depending on the desired distance between the remote percussion head and the percussor body. For example, the percussor body may include a clip means whereby the apparatus may be secured to the belt or other component of a therapist's clothing, or placed on a table with the percussion head being held by the therapist's hand, remotely from the percussor body. However, this is only one example of such an adaptation of the apparatus of the invention, and other embodiments may be used, as will be pointed out further hereinafter. In any event, the percussor body is preferably relatively small and light weight so that it can be readily hand held and carried about.

The interior components of the percussor body illustrated in FIG. 1 are shown in FIG. 2. The body 12 is rigid, and has secured thereto the gas inlet pipe 21 and outlet pipe 13, as previously indicated. Within the body is a hollow cavity 22 in which is located a spool 14. The spool is movable in the cavity between a first position, shown, whereby it is held against O-ring 18, and a second position wherein the spool is elevated in the cavity so that it does not rest against that O-ring. Another gas-sealing O-ring 20 forms a gas-tight seal adjacent the upper portion of the spool whereby a gas pressure chamber 16 is defined between the interior surface of the rigid body defining the cavity 22, and a portion of the spool surface, as shown. Spool 14 is biased in a first position shown in which surface 17 is urged against O-ring 18, forming a gas-tight seal between gas pressure chamber 16 and the rest of the cavity 22. In this condition, gas introduced into the body via inlet pipe 21 and through inlet passageway 15 is initially restricted to pressure chamber 16 between the O-rings 18 and 20. The upper portion of the cavity 22 above the spool is vented to atmosphere via vent port 19, and the lower portion of the cavity sealed off from pressure chamber 16 by O-ring 18 is open to outlet passageway 23.

A spring 26 biases spool 14 downwardly into a first position to cause the gas-tight seal at the point of contact between O-ring 18 and the spool. Spring 26 is preferably adjustable, knob 29 being suitable for that purpose whereby an operator may select the compression of spring 26, and thereby increase or decrease the bias against the spool 14. Adjustment of the spring is of particular importance for changing the shock wave force of the bursts of gas. An O-ring 24 is also preferably positioned to act as a buffer or cushion at the top of the spool.

It is also preferred to incorporate a needle valve 25 so that the rate of gas flowing into the gas pressure chamber may be regulated whereby the frequency of the successive burst of gas may concomitantly be selected. An exterior knob 27 is conveniently secured to the needle valve so that an operator may easily adjust the position of end 11 of the needle valve relative to inlet passageway 15. The spool may be provided with a slot 28 through which the needle valve extends without restricting or interfering with the movement of the spool during operation. Of course, the needle valve may be located elsewhere, for example, at the opposite side of the percussor body so that it need not extend through the spool.

The device operates to produce successive bursts of gas from outlet passageway 23 as gas is introduced into inlet pipe 21 and passageway 15 from a suitable pressurized gas source. The gas pressure will increase in gas pressure chamber 16 until the gas-tight seal between O-ring 18 and spool 14 is overcome, it being understood that the gas pressure on either side of O-ring 18 and 20 will be less than the accumulating gas pressure in chamber 16. Thus, gas in the pressure chamber 16 tends to force spool 14 upwardly from its first position shown in FIG. 2 as the gas pressure is urged against O-ring 20 and the sealing surface of the O-ring 18. Once the gas pressure is sufficient to overcome the gas-tight seal, the spool will be displaced upwardly against bias spring 26, and a burst of pressurized gas from the gas pressure chamber will pass out through gas outlet passageway 23. During movement of the spool, a sliding gas seal is maintained by O-ring 20 against the interior cavity surface. Again, the O-ring 24 will act as a cushion for the spool should it be urged against the upper interior cavity surface.

As indicated, by adjusting the needle valve 25, the rate of percussive repetitions may be varied, whereas by increasing or decreasing the compression of bias spring 26, the magnitude of the burst of gas created as the gas seal is broken may be regulated. Of course, the greater the compression of spring 26, the greater force that will be required to overcome the gas seal, and the greater the magnitude of the percussive force which will be created. Once the gas in gas pressure chamber 16 has been reduced, bias spring 26 overcomes the upward displacement of the spool and force it to return to its first position against O-ring 18, and gas will again accumulate in pressure chamber 16. This sequence will be repeated to achieve the desired percussive effect as successive bursts of gas are directed from the outlet pipe. Although O-ring 18 is shown as being stationary, it may be secured to and move with the spool, whereas O-ring 20 or 24 may be stationary, with the cavity surfaces being appropriately modified. It may also be advantageous to reduce the noise of the operating device by placing some muffling material in vent port 19.

Figure 3:
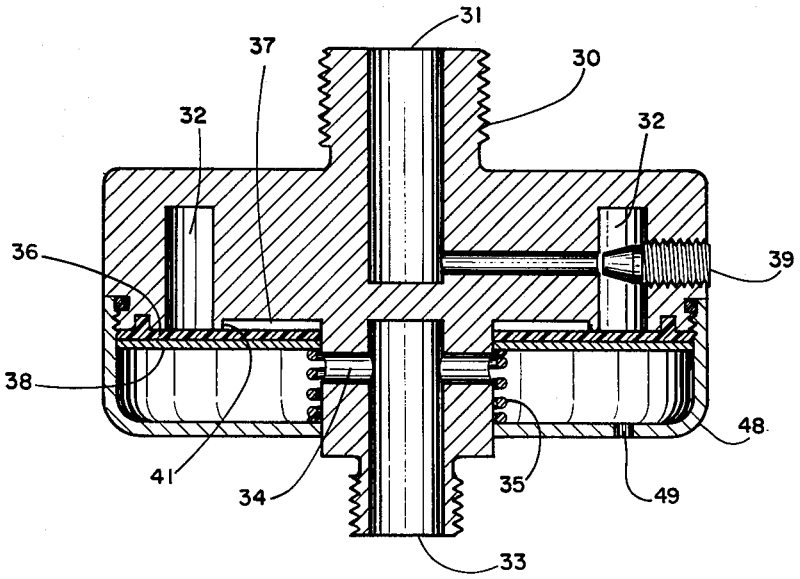
FIG. 3 is a sectional elevation of another embodiment of a percussor body according to the invention.

Another embodiment of a percussor body assembly within the scope of the present invention is illustrated in FIG. 3 in which a rigid percussor body 30 is provided with a gas inlet passageway 31 and outlet passageway 33. This embodiment includes a gas-tight seal formed by diaphragm 36 being urged against diaphragm seat or ridge 41. Gas introduced into inlet passageway 31 is accumulated in the pressure chamber which is in direct communication with the inlet passageway. A needle valve 39 is adjustable to allow selection of the rate of gas flow into the chamber 32. Preferably, a rigid plate 38 supports diaphragm 36, and a spring 35 acts to urge or bias the plate and diaphragm upwardly to maintain a gas-tight seal at ridge 41, in which the diaphragm, acting as a gas sealing member, is held in a first position. A port 34 communicates with outlet passageway 33, and a cover 48 having appropriate seals to prevent leakage of gas is properly positioned.

In operation, pressurized gas is introduced, via gas inlet passageway 31, into gas pressure chamber 32. The cavity below the diaphragm and plate may be maintained at atmospheric pressure by port 49. Once the pressure in the chamber is sufficient to overcome the gas-tight seal of the diaphragm, the diaphragm and plate will be displaced downwardly against bias spring 35 until the pressurized gas can escape through port 34. The pressure in chamber 32 will be relieved, and the diaphragm again forced to its first position. As the gas is suddenly forced from chamber 32 into port 34 and through outlet passageway 33, a burst of gas will be directed to a percussion head. This operation is repeated to achieve the successive bursts of gas and resulting percussion.

Preferably, compression of spring 35 can be varied, for example, by threadedly engaging cover 48, or other suitable means, whereby it can be selectively forced against the spring to achieve the desired spring compression. Again, this spring compression will determine the force or shock wave of the percussive bursts delivered to a percussion head, whereas adjustment of the needle valve 39 will vary the rate of percussion.

Figure 4:
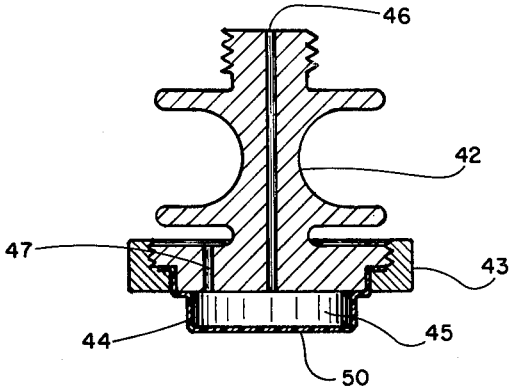
FIG. 4 is a sectional view of the remote percussion head illustrated in FIG. 1.

A percussion head is illustrated in FIG. 4 incorporating a body member 42 through which extends an inlet passageway 46. An elastic diaphragm 44 secured at the bottom of the body by retainer 43, and a diaphragm chamber 45 communicates with inlet passageway 46. A pressure relief port 47 also communicates with the diaphragm chamber. The percussion head offers the advantage of allowing an operator to use it by simply holding this light body in the hand and urging it against the patient for percussive treatment. A tube of any suitable type will be connected between a percussor assembly body, whereby the successive bursts of gas from the gas outlet passageway will be directed to inlet passageway 46 of the percussion head. The pressure entering diaphragm chamber 45 will cause the diaphragm to become expanded, and when the burst gas is terminated, the pressure in the diaphragm chamber is relieved through pressure relief port 47. Thus, as the percussor operates, the successive bursts of gas are corrected to the percussor head, again which may be remote from the percussor assembly body. If desired, instead of utilizing a tube as shown in FIG. 1 for directing the successive bursts of gas from the percussor assembly body to the remote percussor head, a fitting may be used to secure the percussor head directly to the percussor assembly body, and the entire unit may be held in the operator's hand, much like that described in my previous aforesaid co-pending application.

Although the percussor head is shown as incorporating an elastic diaphragm to direct the percussive force, alternative means may incorporate a percussion head like that shown in my aforesaid application. Thus, for example, rather than using an elastic diaphragm, a plunger-type percussion effect may be realized, whereby the bursts of gas are used to force a piston, or the like as previously described, the descripiton thereof being incorporated herein by reference. Alternatively, the burst of gas may be directed against a patient's body without the need of a alternately expanding diaphragm, plunger, or piston. Thus, the patient's body itself may act as a barrier against which the air bursts are directed. In such an embodiment some side cushion, or the like, may be used, for example, by cutting away the flat end surface 50 of diaphragm 44, leaving only the sidewall. Alternatively, a remote percussion head need not be used and instead, the bursts of gas directly applied from the gas outlet passageway of the percussor body assembly, as previously described. Moreover, the two specific embodiments of the types of components for forming gas-tight seals, i.e., O-rings and diaphragm, are only examples of those which may be used to achieve the successive bursts of air from the gas pressure chamber to a percussion head, and others may be used, without departing from the scope of the invention disclosed herein. Finally, although the apparatus described herein has been particularly described in use as a percussor, it need not be so limited. For example, it may be used for directing oxygen or oxygen enriched gas to a mask, cannula, or the like, secured on a patient's face, or along a tube inserted into, or communicating with a patient's airway, or attached to a tracheotomy mask such as shown in U.S. Pat. No. 3,236,236, or trachea instrument shown in U.S. Pat. No. 3,886,946, or the like. In such a use the apparatus may serve as a high frequency ventilator, whereby the successive bursts of gas act to vibrate a column of gas along the patient's airway at selected rates adjusting the device to achieve a suitable gas burst force, or shock wave, normally reduced from that used for percussion. Thus, the apparatus has particularly broader and advantageous use in respiratory therapy.

I claim:

1. A percussor assembly comprising:

a rigid body member having a gas inlet passageway and a single gas outlet passageway, a stationary valve seat and a single moveable diaphragm and biasing means cooperating therewith for urging said diaphragm against said valve seat to provide a gas tight seal between said passageways, a gas pressure chamber between said gas inlet passageway and said valve seat, a single remote applicator pneumatically connected to said gas outlet passageway with a flexible gas supply tubing for receiving bursts of gas therefrom, said applicator having a percussion chamber and an expandable diaphragm exposed thereto, and means for delivering pressurized gas to said gas pressure chamber sufficient to overcome the biasing force of said biasing means whereby said gas tight seal is temporarily broken and a burst of gas passes from said gas pressure chamber through said gas outlet passageway to said percussion chamber causing expansion of said diaphragm.

2. The assembly of claim 1 wherein said biasing means includes a plate member abutting a surface of said diaphragm opposite said stationary valve seat, and a spring abutting said plate member for urging said diaphragm against said stationary valve seat.

3. The assembly of claim 1 wherein said applicator includes a pressure relief port communicating between said percussion chamber and atmosphere.

* * * * *